United States Patent [19]

Canup

[11] 4,409,952

[45] Oct. 18, 1983

[54] ENGINE TIMED IGNITION SYSTEM WITH IMPROVEMENT

[75] Inventor: Robert E. Canup, Poughkeepsie, N.Y.

[73] Assignee: Texaco Inc., White Plains, N.Y.

[21] Appl. No.: 299,691

[22] Filed: Sep. 8, 1981

[51] Int. Cl.[3] ..... F02P 3/00

[52] U.S. Cl. ..... 123/620; 123/626; 123/606

[58] Field of Search ..... 123/620, 605, 606, 598, 123/626

[56] References Cited

U.S. PATENT DOCUMENTS

| | | | |
|---|---|---|---|
| 3,837,326 | 9/1974 | Kamiji | 123/620 |
| 3,838,328 | 9/1974 | Lundy | 123/598 |
| 3,961,613 | 6/1976 | Canup | 123/606 |
| 3,961,617 | 6/1976 | Satake | 123/598 |
| 4,022,177 | 5/1977 | Canup et al. | 123/606 |
| 4,033,316 | 7/1977 | Birchenough | 123/598 |
| 4,122,816 | 10/1978 | Fitzgerald et al. | 123/620 |

FOREIGN PATENT DOCUMENTS

| | | | |
|---|---|---|---|
| 2076466 | 12/1981 | United Kingdom | 123/606 |

*Primary Examiner*—Parshotam S. Lall
*Attorney, Agent, or Firm*—Carl G. Ries; Robert A. Kulason; Henry C. Dearborn

[57] ABSTRACT

An engine timed ignition system of the type that combines a short duration high voltage spark with a reduced voltage DC spark sustaining signal. It includes in the system apparatus for starting the DC sustaining signal simultaneously with the high voltage spark. And, it includes apparatus to positively stop the DC sustaining signal after a predetermined interval in order to avoid a continuing spark discharge.

6 Claims, 1 Drawing Figure

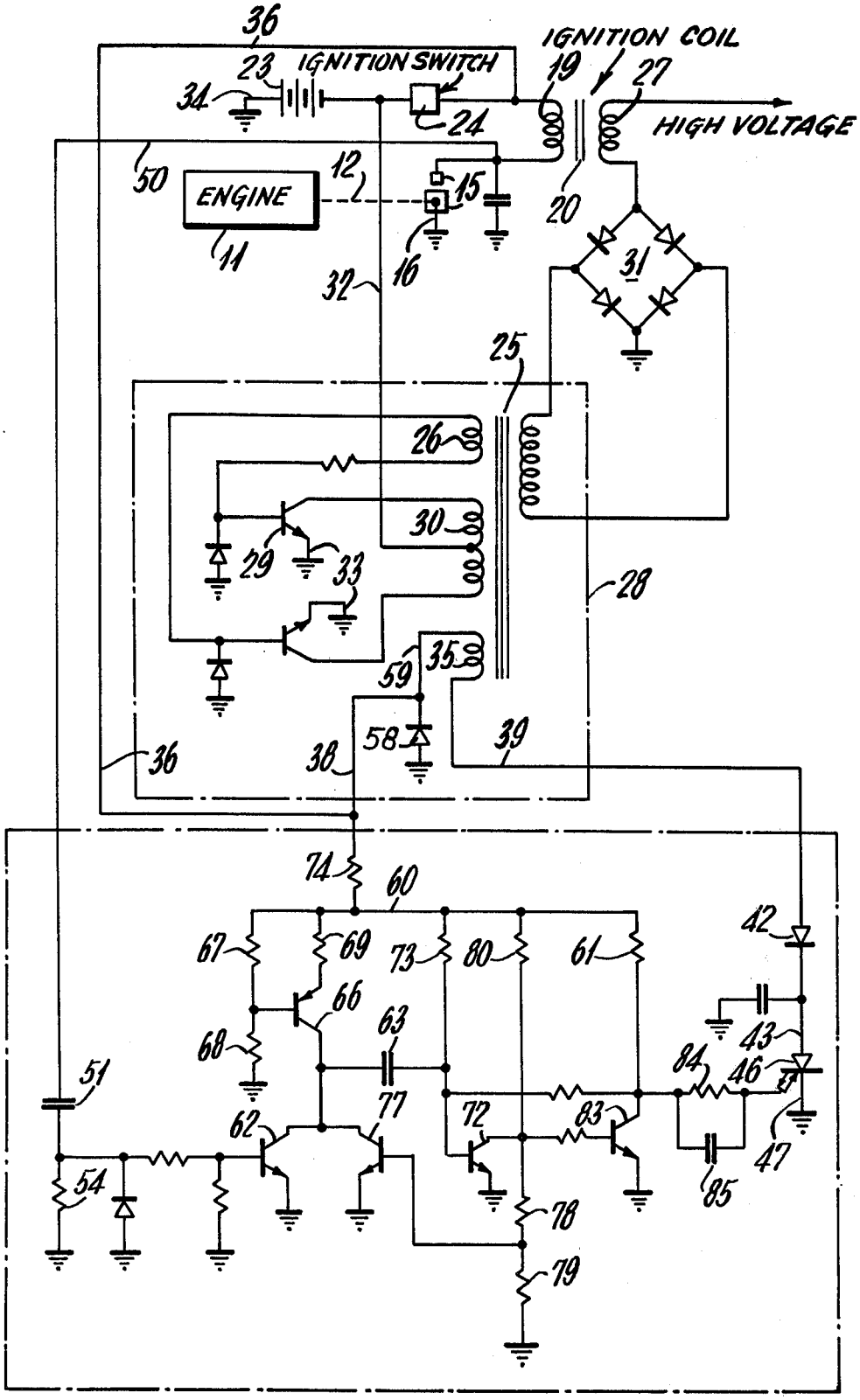
IGNITION COIL
IGNITION SWITCH
HIGH VOLTAGE
ENGINE

ENGINE TIMED IGNITION SYSTEM WITH IMPROVEMENT

CROSS-REFERENCE TO RELATED APPLICATION

Application Ser. No. 152,946 filed May 23, 1980 by this applicant, now U.S. Pat. No. 4,320,735 is referred to in regard to a portion of its disclosure.

BACKGROUND OF THE INVENTION

1. Field Of The Invention

This invention concerns an engine timed ignition system in general. More specifically, it deals with an improved system that makes use of a short duration high voltage spark plus a reduced voltage DC spark sustaining signal.

2. Description of The Prior Art

In an engine timed ignition system, it has been suggested that the conventional short time high voltage spark signal might be supplemented with a lower voltage DC signal that is applied so as to continue the spark discharge for some time thereafter. Two patents which describe ways of carrying out the foregoing suggestion are (1) the U.S. Pat. to Birchenough, No. 4,033,316, issued July 5, 1977, and (2) the patent to Shimojo et al, No. 4,136,301, issued Jan. 23, 1979.

The Birchenough patent provides for creating a conventional inductive discharge type high voltage signal to create the spark which develops at the sparkplug of an internal combustion engine. And, the application of a DC voltage that has sufficient amplitude to keep the spark from being extinguished thereafter. However, in the system which Birchenough discloses, there is a difficulty in connection with the spark discharge continuing beyond the need therefor at each cylinder of the engine. Thus, even though the spark discharge was supposed to be extinguished by the engine's operational cycle in reliance upon the exhaust, intake or compression in the cylinder, it was not found to be effective in extinguishing the spark discharge. Similarly, whereas Birchenough suggested that the distributor rotor would break the current path to each cylinder, it has been found that a damaging discharge would continue unabated.

In contrast, the applicants' system positively cuts off the DC sustaining voltage at the end of a predetermined time interval so that the next spark discharge can be controlled and regulated, in a similar manner for each cylinder of the engine.

In the Shimojo et al patent, the same type of problem was recognized, and it attempts to overcome the difficulty by having its DC to DC converter connected so as to be developing an auxiliary or sustaining DC signal prior to the introduction of the spark initiating signal. It includes a feedback arrangement in the DC to DC converter to control the current supply and so permit the spark to be extinguished when the pressure in a cylinder increases. Consequently, the system of Shimojo et al does not start the two signals simultaneously, nor does it act to stop the oscillator of the DC to DC converter when the spark termination is desired.

Thus, it is an object of this invention to provide an improved system for using an engine timed ignition signal that includes a short duration high voltage spark initiating signal, plus a reduced voltage DC spark sustaining signal which latter is commenced simultaneously with the initiating signal and is positively stopped after a predetermined time interval.

SUMMARY OF THE INVENTION

Briefly, the invention is in combination with an engine timed ignition system having a short duration high voltage spark initiating signal. The combination includes means for adding a DC spark sustaining signal therewith, and in such combination, the improvement comprises means for starting said spark sustaining signal simultaneously with said initiating signal. And, it comprises means for stopping said spark sustaining signal a predetermined time after said simultaneous start.

Once more briefly, the invention lies in combination with an engine timed ignition system having a short duration high voltage spark initiating signal, and including means for adding a DC spark sustaining signal therewith. The said last named means comprises a DC to DC converter, and the said converter comprises an oscillator which includes a transformer that has an output winding with a full wave rectifier connected thereto. In the foregoing combination the improvement comprises means for starting said spark sustaining signal simultaneously with said initiating signal. The said starting means comprises (a) a start-stop control winding on said transformer, and (b) circuit means for applying a DC bias to said control winding when said oscillator is not oscillating. The starting means also comprises (c) a gate-turn-off silicon controlled rectifier for cutting off said DC bias to produce a decaying magnetic field for starting said oscillator, and (d) breaker points for developing a signal to actuate said silicon controlled rectifier and for initiating said high voltage initiating signal. Also, the improvement comprises means for stopping said spark sustaining signal a predetermined time after said simultaneous start. The said stopping means comprises (a) an AC short circuit path in parallel with part of said DC bias path, and (b) a rectifier in series with said start-stop control winding and said gate-turn-off silicon controlled rectifier. The foregoing is such that said oscillator is loaded so as to prevent oscillation thereof, and said sustaining signal is cut off.

BRIEF DESCRIPTION OF THE DRAWING

The foregoing and other objects and benefits of the invention will be more fully set forth below in connection with the best mode contemplated by the inventor of carrying out the invention, and in connection with which there is an illustration provided in the drawing, wherein:

the FIGURE of drawing is a schematic circuit diagram illustrating the elements of the best mode contemplated for carrying out the invention.

DESCRIPTION OF THE PREFERRED EMBODIMENT

In engine timed ignition systems, it has been proposed to combine the conventional short-time high-voltage spark initiating signal with a lower voltage spark sustaining signal in order to increase the length of the spark duration. Two examples of such a proposal are described in the above noted U.S. patents, i.e., the patents to Birchenough and Shimojo et al. However, as a practical matter it has been found that a substantial difficulty develops in connection with stopping the spark discharge once its continuation is being sustained by the lower voltage DC signal. On the other hand, the applicant's system provides for an arrangement that overcomes that and other problems and difficulties that were found in the prior systems.

With reference to the figure of drawing, it is to be noted that the system includes a conventional inductive discharge ignition portion to which there is added a spark sustaining signal. The total system provides for benefits according to this invention. The illustrated system includes an engine 11 that controls the ignition timing in a conventional manner, e.g. by having a mechanical connection 12 (indicated by a dashed line) which drives breaker points 15 that are schematically indicated. One side of the breaker points 15 is electrically grounded as indicated by a ground connection 16. The ungrounded side (of the breaker points 15) is connected to one end of a primary winding 19 of an ignition coil 20 which is indicated by the caption. There is a battery 23 that has one side grounded in a conventional manner. The other side is connected to an ignition switch 24 which applies the DC battery potential to the primary winding 19 of the ignition coil 20 when the ignition switch is turned on. This much of the system is, of course, conventional and well known. When the ignition is activated by turning on the ignition switch 24, the cranking of the engine will activate the breaker points 15 and on each opening of the points the inductive discharge (i.e., the magnetic field decay of the primary winding 19) will generate a conventional short-duration high-voltage spark initiating signal in a secondary winding 27 of the ignition coil 20.

A DC spark sustaining signal is created by a DC to DC converter that includes an oscillator 28 (enclosed by the dashed lines) plus a full wave rectifier 31. The oscillator 28 has DC battery voltage of the battery 23 connected to it via a circuit connection 32 with the return via grounded connections 33 that go back to a ground connection 34 at one side of the battery 23. That circuit constitutes the input side of the aforementioned DC to DC converter, while the output side provides a higher DC voltage at the output of the full wave rectifier 31. Rectifier 31 is in series with the high voltage winding 27 of the ignition coil 20 so as to provide a DC sustaining signal for the spark.

The oscillator 28 is a square wave type oscillator, and it is substantially like those shown and described in a number of the applicant's patents, e.g. U.S. Pat. No. 3,749,973 of July 31, 1973 and 3,820,520 of June 28, 1974. And, it acts in a well known manner to cause a pair of transistors 29 to conduct alternately through the halves of a center tapped winding 30, on account of the feed back from a winding 26 that is also on a transformer 25 of the oscillator 28. The oscillator includes a control winding 35 that acts to start and stop the oscillation. The starting is quite instantaneous and the stopping is very positive.

When the breaker points 15 are closed, the primary winding 19 of the ignition coil is energized and at the same time there is a DC bias connected through the control winding 35 of the oscillator 28. The circuit for that DC bias goes from the far side (from the battery 23) of ignition switch 24 over a circuit connection 36 and other circuit connections 38 and 59 to one side of the start-stop control winding 35. Then it continues over another circuit connection 39 to a diode 42, and via another circuit connection 43 to the anode of a gate-turn-off silicon controlled rectifier 46. The cathode of the rectifier 46 is grounded by a connection 47, as indicated. Thus, when the breaker points 15 are closed and the silicon controlled rectifier 46 is conducting, the indicated DC bias current will be flowing through the start-stop control winding 35 in the oscillator 28.

When the breaker points 15 open, a conventional high voltage starting signal is generated in the ignition coil 20. And, simultaneously the DC bias current flowing through the control winding 35 (of oscillator 28 in the DC to DC converter) will be cut off. That current cut off causes a decaying flux which gives a starting kick to the oscillator 28 so that the output DC from the full wave rectifier 31 is instantaneously and simultaneously supplied in series with the foregoing high voltage spark initiating signal. The output DC from rectifier 31 acts as a lower voltage DC spark sustaining signal.

It may be noted that the simultaneous starting of the spark sustaining signal with the spark initiating signal, as described above, includes the action indicated which removes the DC bias on the control winding 35. That action is caused by the turning off of the silicon controlled rectifier 46. Such turnoff is accomplished by a signal taken from the breaker points 15 which signal goes over a circuit connection 50 and via a capacitor 51 to one side of a resistor 54, the other side of which is grounded. That creates a control pulse which actuates the silicon controlled rectifier 46 and turns it off for a predetermined length of time.

The length of time that the rectifier 46 remains turned off is determined by a pulse rate control circuit which is connected to the gate of rectifier 46 and is located at the middle of dashed lines box 55 and which will be described further hereafter.

At the end of that predetermined length of time, an AC short circuit path is connected across the control winding 35 in parallel with part of the aforementioned DC bias path. Thus, when the rectifier 46 is again made conducting, an AC short circuit path is provided across the start-stop control winding 35. Such path is illustrated by a circuit that includes a diode 58 which has one side grounded. It may be noted that it is connected with its polarity such that the DC bias is not permitted to flow therethrough.

That AC short circuit path may be traced from ground through the diode 58 and via a circuit connection 59 to one end of the winding 35. The other end of winding 35 is connected via the circuit connection 39 to the diode 42 and on over the circuit connection 43 to the anode of the rectifier 46 which has its cathode grounded via circuit connection 47 completing the path. This AC short circuit path loads the oscillator 28 and so positively stops oscillation thereof. Consequently, the DC output from the full wave rectifier 31 is terminated and thus the spark sustaining signal is cut off.

As noted above, the rectifier 46 is a gate-turnoff type of silicon controlled rectifier and the control may be like that described in a copending application of the applicant's, Ser. No. 152,946 filed May 23, 1980, now U.S. Pat. No. 4,320,735 insofar as the application of a control signal to the gate of the SCR 46 is concerned. It will be understood that the abbreviation SCR stands for silicon controlled rectifier.

The control signal for SCR 46 is applied to the gate via a resistor 84 and capacitor 85 in parallel. And, when a transistor 83 is not conducting there is current flow from the battery 23 via the circuit connection 36 and a resistor 74 to a common circuit connection 60 and via a resistor 61 to the resistor 84 and into the gate of SCR 46. Such current flow is sufficient to have SCR 46 regenerative and consequently it will be turned on.

While there might be different arrangements for controlling the conductivity or non-conductivity of the SCR 46, it is preferred to employ a control circuit as illustrated by part of that portion of the circuit in the drawing which is enclosed in the dashed lines 55. Such control circuit acts to provide a turnoff of the SCR 46 for a time duration that is inversely proportional to the frequency of the signals being generated by the breaker points 15. In that manner, the application of the sustaining DC signal (from full wave rectifier 31) may be controlled so as to act over a time period so related to the engine speed as to coincide with a constant crank angle degree.

As indicated above, signals from the breaker points 15 are carried over the circuit connection 50 and via the capacitor 51 to the resistor 54 where the pulses developed are applied to the base of a transistor 62. When the transistor 62 is turned on by the pulse received, it discharges one side of a capacitor 63 which has that side also connected to the collector of a PNP transistor 66 that is connected as a constant current generator by having resistors 67, 68 and 69 connected therewith. The other side of the capacitor 63 is connected to the base of another transistor 72 that is normally conducting by having the base connected via a resistor 73 to the battery voltage via the common connector 60 and another resistor 74 that is connected to the circuit connection 36.

When the pulse is received via the input to transistor 62 and the latter conducts (as indicated above), it causes transistor 72 to turn off through capacitor 63. And, when transistor 72 stops conducting it makes another transistor 77 conduct and remain so concurrently with the non-conducting state of transistor 72. This is because of a potentiometer circuit of resistors 78 and 79. plus another resistor 80. Thus, when the transistor 72 is cut off, the transistor 77 goes conducting and remains so irrespective of the condition of transistor 62. Instead, it follows the transistor in reverse and conducts whenever the latter is off. It is the time intervals that the transistor 72 remains cut off which provide the inversely proportional relationship with speed of the engine.

The foregoing timing circuit is known and it need not be explained other than to note that the interaction of the circuits on both sides of the capacitor 63 is such that the intervals during which the transistor 72 is non-conducting (and transistor 77 is conducting) are controlled in a linear manner that is inversely proportional with the speed or frequency of the pulses introduced by the transistor 62 which depend upon the signals from the breaker points 15.

It will be noted that when the transistor 72 is cut off a transistor 83 becomes conducting and this applies a negative signal to the gate of the SCR 46 via a resistor 84 and a capacitor 85 thereacross. Then, the cutting off of conduction of SCR 46 will act to cut off the DC bias current flowing through the control winding 35 and remove the AC short circuit. Consequently this starts the oscillator 28 and thus supplies the sustaining DC potential at the output of the full wave rectifier 31. That DC will then continue for the time interval as determined by the arrangement just described so as to be acting over a given crank angle degree irrespective of the speed. At the end of each such interval the SCR 46 will once more go conducting and consequently, there will be the above described AC short circuit applied to the control winding 35 which positively cuts off the oscillator 28 and so stops the supplementary DC voltage at the output of the full wave rectifier 31. In this manner, the problem of stopping the sustaining DC signal so that the spark discharge will be terminated, is overcome by positive action.

While a particular embodiment of the invention has been described above in considerable detail in accordance with the applicable statutes, this is not to be taken as in any way limiting the invention but merely as being descriptive thereof.

I claim:

1. In combination with an engine timed ignition system having a short duration high voltage inductive discharge spark initiating signal and including means for adding a DC spark sustaining signal therewith, the improvement comprising:

means for starting said spark sustaining signal simultaneously with said initiating signal, and means for positively stopping said spark sustaining signal a predetermined time interval after said simultaneous start, said predetermined time interval being inversely proportional with the speed of said engine.

2. The invention according to claim 1, wherein said DC spark sustaining signal means comprises a DC to DC converter having an oscillator, said oscillator comprising a transformer having a start-stop control winding thereon, and means for applying a DC bias to said start-stop control winding while said oscillator is not oscillating, said starting means comprising electronic switch means for cutting off said DC bias to produce a decaying magnetic field for starting said oscillator, and said stopping means comprising circuit means associated with said electronic switch for applying an AC short circuit to said start-stop winding for loading said oscillator to prevent oscillation thereof whereby said DC spark sustaining signal is cut off.

3. The invention according to claim 2, wherein said starting means also comprises second switch means for actuating said spark initiating signal, and circuit means for connecting said second switch means to actuate said electronic switch means whereby said sustaining and starting signals are generated simultaneously.

4. The invention according to claim 3, wherein said electronic switch means comprises a gate-turn-off silicon controlled rectifier, and said second switch means comprises breaker points.

5. The invention according to claim 4, wherein said DC to DC converter also has a full-wave rectifier in series with said spark initiating signal.

6. In combination with an engine timed ignition system having a short duration high voltage spark initiating signal and including means for adding a DC spark sustaining signal therewith, said last named means comprising a DC to DC converter, and said converter comprising an oscillator including a transformer having an output winding with a full wave rectifier connected thereto, the improvement comprising means for starting said spark sustaining signal simultaneously with said initiating signal, said starting means comprising (a) a start-stop control winding on said transformer (b) circuit means for applying a DC bias to said control winding when said oscillator is not oscillating (c) a gate-turn-off silicon controlled rectifier for cutting off said DC bias to produce a decaying magnetic field for starting said oscillator, and (d) breaker points for developing a signal to actuate said silicon controlled rectifier and for initiating said high voltage initiating signal, and means for stopping said spark sustaining signal a predetermined time after said simultaneous start, said stopping means comprising (a) an AC short circuit path in parallel with part of said DC bias path, and (b) a rectifier in series with said start-stop control winding and said gate-turn-off silicon controlled rectifier, whereby said oscillator is loaded to prevent oscillation thereof and said sustaining signal is cut off.

* * * * *